US008439659B2

(12) United States Patent
Loeker et al.

(10) Patent No.: US 8,439,659 B2
(45) Date of Patent: May 14, 2013

(54) ECCENTRIC SCREW PUMP WITH SPLIT STATOR

(75) Inventors: Denise Loeker, Gladbeck (DE); Michael Sobolewski, Essen (DE)

(73) Assignee: seepex GmbH, Bottrop (DE)

( * ) Notice: Subject to any disclaimer, the term of this patent is extended or adjusted under 35 U.S.C. 154(b) by 573 days.

(21) Appl. No.: 12/671,508

(22) PCT Filed: Aug. 13, 2008

(86) PCT No.: PCT/EP2008/006641

§ 371 (c)(1),
(2), (4) Date: Feb. 24, 2010

(87) PCT Pub. No.: WO2009/024279

PCT Pub. Date: Feb. 26, 2009

(65) Prior Publication Data

US 2010/0196182 A1 Aug. 5, 2010

(30) Foreign Application Priority Data

Aug. 17, 2007 (DE) ..... 10 2007 039 062
Feb. 28, 2008 (DE) ..... 10 2008 011 690
May 2, 2008 (DE) ..... 10 2008 021 920

(51) Int. Cl.
*F04C 2/107* (2006.01)

(52) U.S. Cl.
USPC ..... 418/48; 418/45

(58) Field of Classification Search ..... 418/45, 418/48

See application file for complete search history.

(56) References Cited

U.S. PATENT DOCUMENTS 2,527,670 A * 10/1950 Allen ..... 418/48
3,354,537 A * 11/1967 O'Connor ..... 29/888.023
3,512,904 A * 5/1970 Allen ..... 418/48
3,603,407 A * 9/1971 Clark ..... 175/6
3,643,877 A * 2/1972 Zimmer ..... 241/46.02
4,449,953 A * 5/1984 Nikomarov et al. ..... 464/19
4,499,561 A * 2/1985 Mason et al. ..... 366/156.2
5,439,359 A * 8/1995 Leroy et al. ..... 418/48
5,474,432 A * 12/1995 Hulley et al. ..... 418/48
5,688,114 A * 11/1997 Millington et al. ..... 418/48
5,735,436 A * 4/1998 Schroeder et al. ..... 222/129.1
5,769,618 A * 6/1998 Ono et al. ..... 418/48

(Continued)

FOREIGN PATENT DOCUMENTS

DE 2313261 9/1974
DE 4413818 10/1995

(Continued)

*Primary Examiner* — Kenneth Bomberg
*Assistant Examiner* — Dapinder Singh
(74) *Attorney, Agent, or Firm* — Andrew Wilford

(57) ABSTRACT

An eccentric screw pump has a plurality of segments extending along an axis and together forming a tubular casing generally centered on the axis and a plurality of axially extending stator shells of elastic material together forming inside the casing a tubular stator having axially opposite ends each having centered on the axis a frustoconical end seal surface. The stator shells are separable from the casing segments. An intake housing has a connecting flange formed centered on the axis with a frustoconical flange surface fitted with one of the end seal surfaces of the stator, and an output fitting has a connecting flange formed centered on the axis with a frustoconical flange surface fitted with the other of the end seal surfaces of the stator. A rotor extends axially in the stator, the stator being clamped by the casing against the rotor.

11 Claims, 9 Drawing Sheets

U.S. PATENT DOCUMENTS

| | | | | |
|---|---|---|---|---|
| 6,162,032 | A * | 12/2000 | Jager | 418/48 |
| 7,040,878 | B2 * | 5/2006 | Denk et al. | 418/48 |
| 7,137,795 | B2 | 11/2006 | Kamal | 418/48 |
| 7,396,220 | B2 * | 7/2008 | Delpassand et al. | 418/48 |
| 7,465,157 | B2 * | 12/2008 | Weber | 418/48 |
| 7,473,082 | B2 * | 1/2009 | Marielle | 418/48 |
| 7,618,246 | B2 * | 11/2009 | Frisch et al. | 418/48 |
| 7,871,253 | B2 * | 1/2011 | Kreidl et al. | 418/48 |
| 2005/0079083 | A1 * | 4/2005 | Lievestro et al. | 418/48 |
| 2006/0182644 | A1 * | 8/2006 | Delpassand et al. | 418/45 |
| 2007/0128062 | A1 * | 6/2007 | Frisch et al. | 418/45 |
| 2008/0085203 | A1 * | 4/2008 | Amburgey et al. | 418/48 |

FOREIGN PATENT DOCUMENTS

| | | |
|---|---|---|
| EP | 0943803 | 9/1999 |
| EP | 0994256 | 4/2000 |
| FR | 1488652 | 6/1967 |

* cited by examiner

ECCENTRIC SCREW PUMP WITH SPLIT STATOR

CROSS REFERENCE TO RELATED APPLICATIONS

This application is the US national phase of PCT application PCT/EP2008/006641, filed 13 Aug. 2008, published 26 Feb. 2009 as WO2009/024279, and claiming the priority of German patent application 102007039062.0 itself filed 17 Aug. 2007, German patent application 102008011690.0 itself filed 28 Feb. 2008, and German patent application 102008021920.7 itself filed 2 May 2008, whose entire disclosures are herewith incorporated by reference.

The invention relates to an eccentric screw pump comprising at least one stator made of elastic material and a rotor mounted in the stator, the stator being surrounded at least partially by a stator casing or housing. In this type of eccentric screw pump, the rotor is generally connected by at least one shaft that has a universal joint to a drive or drive shaft. The pump has an intake housing and an output fitting, one end of the stator being connected to a connecting flange of the intake housing while its other end is connected to a connecting flange of the output fitting. Within the context of the invention, elastic material refers in particular to an elastomer, for example a (synthetic) rubber or a rubber mixture. Also included here are composite materials made of an elastomer or other material, for example metal.

Eccentric screw pumps are well known in practice in which the elastic stator is vulcanized into a stator casing made for example of metal. The elastomeric stator is subject to wear when in operation, with the result that maintenance work or replacement of the stator is required at regular intervals. In practice, the stator along with its molded-on stator casing is often replaced to accomplish this.

For reasons of cost and also environmental protection, the proposal has thus been made to fabricate the elastomeric stator and the stator casing or stator housing as separate components. During assembly, the stator can thus be inserted into the cylindrical metal stator casing, thereby enabling only the stator to be replaced after a given amount of wear, while the stator casing can be reused. Stators of this type are designated as removable stators. In practice, however, installation of this type of removable stator is often costly and involves extensive disassembly of the eccentric screw pump. The invention addresses this problem.

The object of the invention is to create an eccentric screw pump of the type described above that allows for replacement of the elastomeric stator in a manner that is cost-effective and simple with respect to installation technology.

To solve this problem, the invention teaches an approach for a generic eccentric screw pump where the stator is longitudinally split, being made of at least two stator shells. There are thus preferably two stator shells that are formed as half-shells and each extend over an angle of 180°. However, the invention also comprises split stators having three, four, or even more stator shells that thus each extend over an angle of 120° or 90° or even less.

The invention is first of all based on the insight that it is advantageous to produce the elastomeric stator as a component that is replaced separate from the stator casing or housing so as to allow for a replacement only of the elastomeric part and reuse of the stator casing. What is also achieved by the invention, however, is an especially simple installation since the longitudinally split design of the elastomeric stator enables replacement to be done without the necessity of a costly and complex disassembly of the pump. The pump can remain installed in its essential setup on, for example a base or mounting plate. Both the intake and the output fittings, as well as the rotor, can remain in place. The two or more stator shells can be simply installed around the rotor. To this end, the ends of the stator are connected to a flange of the output fitting, the separate stator shells being fitted in place individually without the necessity of completely disassembling the pump. This is accomplished in that the stator shells are elastically deformable, and therefore flexible or bendable for purposes of insertion and use. It may be advantageous to not install the stator or the stator shells directly onto the connecting flanges, but instead to provide adapters that are attached to the connecting flange(s). These for example annular adapters are fitted to the shape of the stator or the stator shells, with the result that the adapters essentially also provide the ability to use the longitudinally split stator according to the invention in combination with conventional pump housings, or intake housings and output fittings. The adapters can also serve as centering rings.

According to an especially advantageous embodiment of the invention, the end seal surfaces of the stator or stator shells can be inserted into a stator seat of the respective connecting flange or output fitting, or fit over a seat formation thereon. This insertion of the stator ends into appropriate stator seats or fitting over an external stator seat ensures, in particular, a flawless seal during installation of the stator housing since the end seal surfaces engage the seats, or (conversely) the projecting stator seats engage the seal surfaces of the stator, during installation of the stator housing or stator casing.

What is preferred in particular is for the stator to have end frustoconical seal surfaces, preferably external frustoconical or internal frustoconical seal surfaces, while the described stator seats of the connecting flanges or adapters have frustoconical, preferably internal frustoconical or external frustoconical seal surfaces. In a first embodiment, the end seal surfaces of the stator are of internal frustoconical shape and contact the internal frustoconical seal surfaces of the stator seat. In a modified preferred embodiment, the stator at the end has internal frustoconical seal surfaces, while the stator seats on the connecting flange or on the adapter have external frustoconical seal surfaces. In this embodiment, the stator seat projects is essentially on or parallel to the axis from the connecting flange or the adapter, with the result that the stator seat engages the stator end or the stator is slipped over the stator seat. This approach allows an especially good seal to be formed. An overall excellent seal is ensured by the taper or frustoconical shape. The apex angle of the seal surfaces or of the sealing counter-surfaces can be 10° to 50°, preferably 20° to 30°.

In another proposal of the invention, which is of particular importance, not only the stator itself is designed as a longitudinally split stator, but the stator casing is longitudinally split and for thus purpose has at least two, preferably at least four, casing segments. This too contributes to the fact that the elastomeric stator constituting a wear part can be replaced without significant disassembly since even the multipart stator casing can now be removed without having to remove the intake housing, output fitting, and/or rotor from their installed position. In addition, this type of longitudinally split stator casing with its multiple casing segments at the same time forms a stator holder or stator clamp that clamps the stator in particular radially against the rotor. Here the invention is based on the insight that the elastomeric stator is normally installed with an initial clamping prestress relative to the rotatably driven rotor, the functioning of the eccentric screw pump basically depending on this initial prestress. Notwithstanding the simple design and, in particular, the simple replacement of the stator, it is possible to set the desired level of the initial prestress highly effectively, and, in particular, also to readjust prestress to account for wear. At the same time, the seal of the longitudinally split stator is ensured by the multipart holder. The stator holder here not only ensures an adequate seal or attachment of the two stator shells relative to each other, but also a tight connection or a tight engagement of the stator ends with the corresponding stator seats of the connecting flanges or adapters.

The invention proposes in this regard that the casing segments externally contacting the stator have, for example attachment flanges at their ends for attachment to the connecting flange or adapter. For clamping the stator, these attachment flanges can be connected by fasteners to the connecting flange or adapter. The fasteners here can be in the form of screw assemblies, thereby enabling the desired initial prestress to be easily set or readjusted. The casing segments along with their attachment flanges are adapted to the shape of the stator, and of the connecting flanges or adapters, such that attachment of the attachment flanges to the connecting flanges or adapters is affected so as to form an adjustable annular gap. This gap can have a gap width measuring at most 10 mm, preferably at most 5 mm. It may thus be advantageous to initially install the attachment flanges with a gap width of, for example 5 mm, thereby allowing a clamping adjustment to be effected measuring a total of 5 mm of clamping travel.

The attachment flanges here can engage the connecting flange, or overlap or surround the adapter. In this regard, reference is made to the drawing and description of the figures.

In addition, the invention proposes that one or more, preferably all, of the stator shells each have at least one externally projecting rotation-blocking formation. This rotation-blocking formation can be attached externally to the stator shells, for example in the form of a longitudinal ridge. The shape of the stator shells along with their longitudinal ridges here are preferably adapted to the shape of the multiple casing segments, with the result that within the scope of the invention the longitudinal ridges engage respective spaces between two adjacent casing segments so as to block rotation. In addition, these ridges can also have end faces that function as axial stops and to this end rest against the adapters or connecting flanges.

All in all, the stator according to the invention can be easily installed and replaced without having to detach, for example output fittings or pressure lines. The required rotor-stator clamping can be readily adjusted. The stator is simple to manufacture in terms of stator shape since precise dimensional accuracy is no longer required.

In the following the invention is described in more detail with reference to a drawing showing only one embodiment. Therein:

Figure 1:
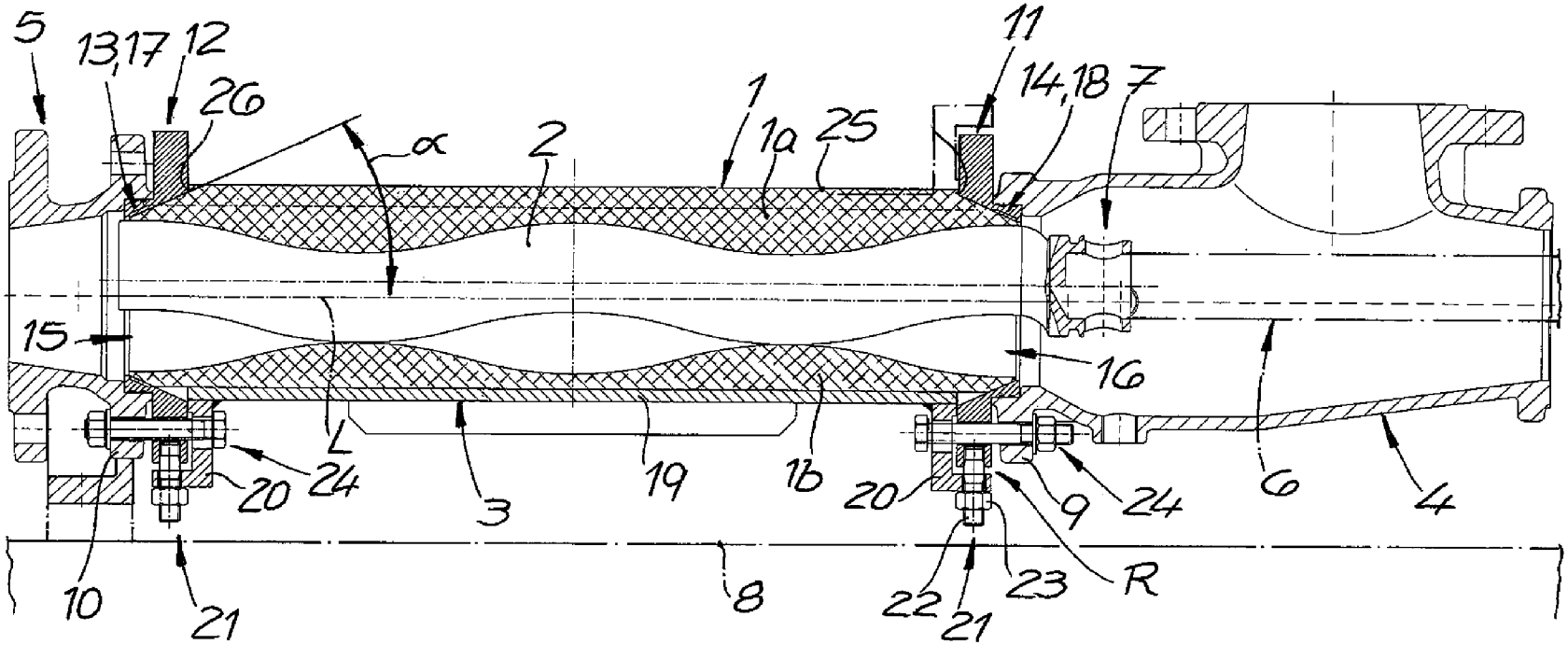
FIG. 1 is a simplified longitudinal section through an eccentric screw pump according to the invention.
Figure 3:
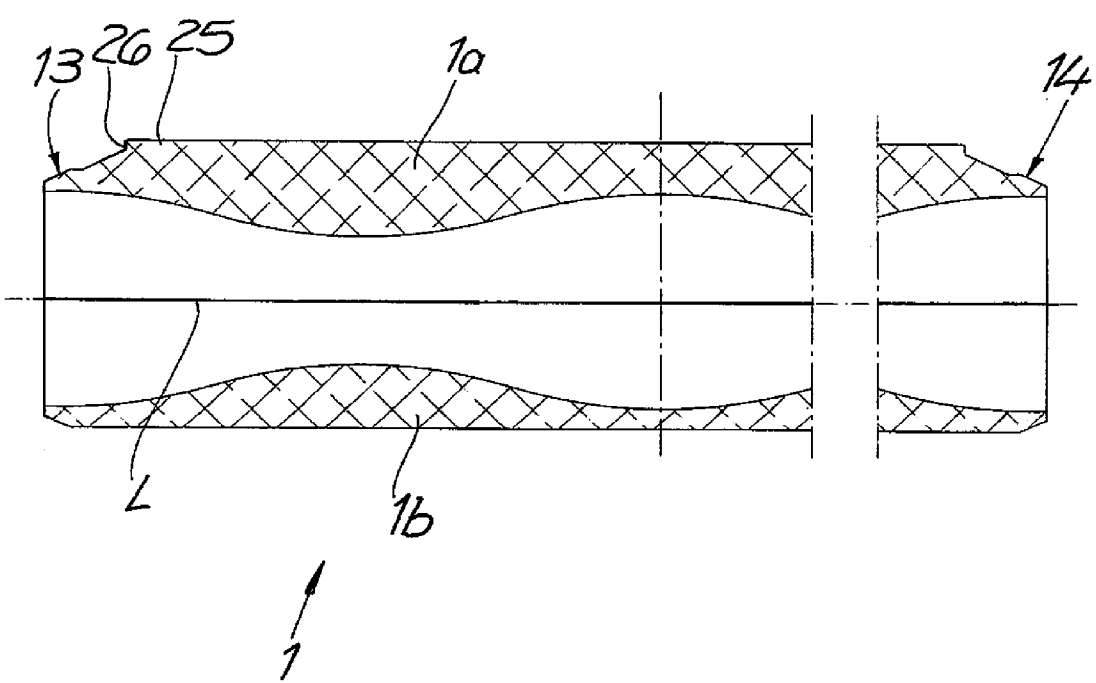
FIG. 3 is section A-B through the item of FIG. 2.
Figure 2:
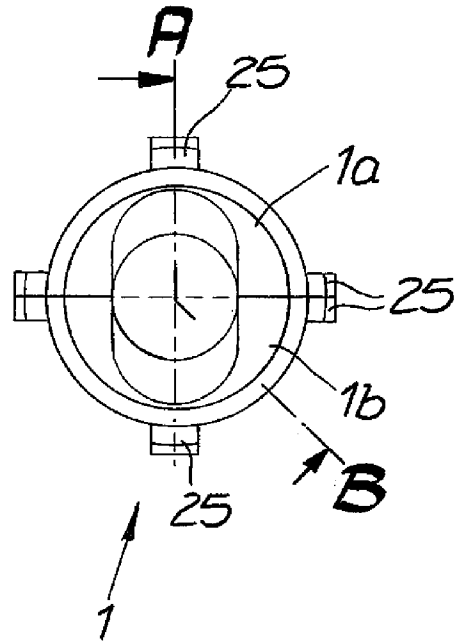
FIG. 2 is a front end view of a longitudinally split stator according to the invention.
Figure 4:
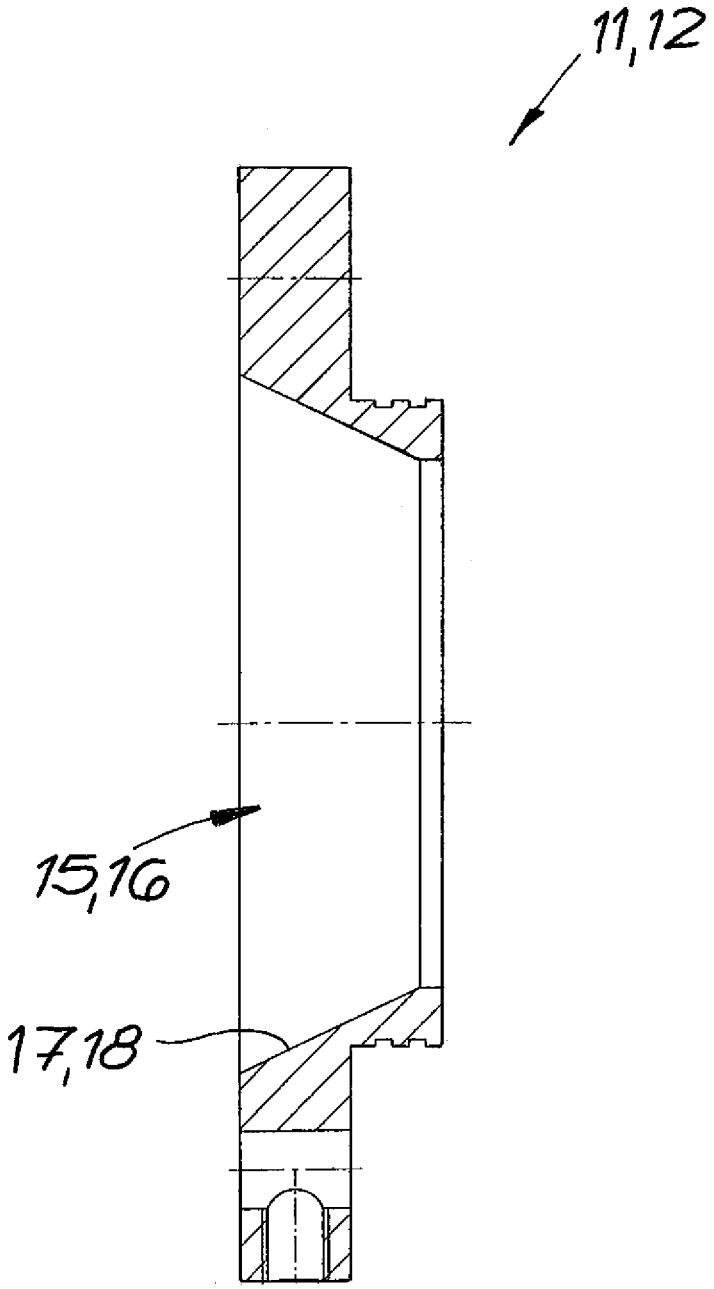
FIG. 4 shows an adapter according to the invention for the pump of FIG. 1.

The figures show an eccentric screw pump that basically comprises a stator 1 of elastic material and a rotor 2 mounted in the stator 1, with the stator 1 surrounded at least partially by a stator casing 3. In addition, the pump has an intake housing 4 as well as a connection or pressure fitting 5. An unillustrated drive is also provided that rotates the rotor 2 by means of a drive shaft 6 indicated only in outline. The drive shaft is connected at one end by a coupling to the rotor 2 and at the other end to an unillustrated motor output shaft, only the rotor-end coupling 7 being shown. The pump is typically mounted on a base plate 8 shown only in outline, the base plate being supplied with the pump or provided by the user. The stator 1 is connected in a manner known per se at its one end to a connecting flange 9 of the intake housing 4 and at its other end to a connecting flange 10 of the output fitting 5. In the embodiment shown here, the connection is not directly to these connecting flanges 9 and 10, but through respective adapter 11 and 12 whose construction will be explained in more detail below. These adapters are also called centering rings.

According to the invention, the stator 1 is longitudinally split and to this end is made of two stator shells 1*a* and 1*b* that in the illustrated embodiment are half-shells each extending over an angle of 180°. The term longitudinally split means along the longitudinal axis of the stator L or parallel thereto. The separating plane between shells thus runs along or parallel to the longitudinal axis L.

This longitudinally split design of the elastomeric stator allows the stator 1 to be removed and installed while the intake housing 4, the output fitting 5, and the rotor 2 remain in place, since the stator 1 does not have to be pushed onto the rotor 2 from one end as in the prior art, for example after removal of the output fitting 5.

In order to ensure a sufficiently tight seal for the stator despite this split design, the stator 1 or its shells 1*a* and 1*b* have end seal surfaces 13 and 14 (or 13' and 14'). The end seal surfaces 13 and 14 of the stator shells 1*a* and 1*b* are fitted one after the other to respective stator seats 15 and 16, or can fit with seal surfaces 13' and 14' over onto the stator seats 15' and 16', and in the illustrated embodiments with adapters these stator seats are provided on the adapters 11 and 12. The adapters 11 and 12 themselves form seats as known per se on the intake housing 4 at one end and on the output fitting 5 at the other end, with the result that the intake housing 4 at one end and the output fitting 5 at the other end can be of conventional design and consequently can also be used with conventional one-piece stators. The end seal surfaces 13 and 14 (or 13' and 14') of the stator 1 are of frustoconical shape or designed as frustoconical surfaces, and specifically, "external frustoconical" in the embodiment of FIGS. 1 through 7. The stator seats 15 and 16 (or 15' and 16') also have corresponding frustoconical sealing counter-surfaces 17 and 18 (17' and 18') that, as indicated in FIGS. 1 through 7, can be of internal frustoconical shape. The apex angle $\alpha$ shown in FIG. 1 relative to longitudinal axis L in the embodiment here measures approximately 25°. The seal is effected by elastic pinching. The stator casing 3 is provided in order to fix and seal the stator shells 1*a* and 1*b*. This casing is designed according to the invention longitudinally split and to this end has multiple casing segments 19, four in the illustrated embodiment. This stator casing 3 along with its casing segments 19 thus forms a stator holder or stator clamp that on the one hand fixes and seals the longitudinally split stator 1 and on the other hand establishes a desired prestress or initial prestress is in the stator 1. Within the scope of the invention, this is achieved in an especially uniform manner since this approach employs four or even more casing segments 19. Only one of these casing segments is shown in FIG. 1.

Figure 5:
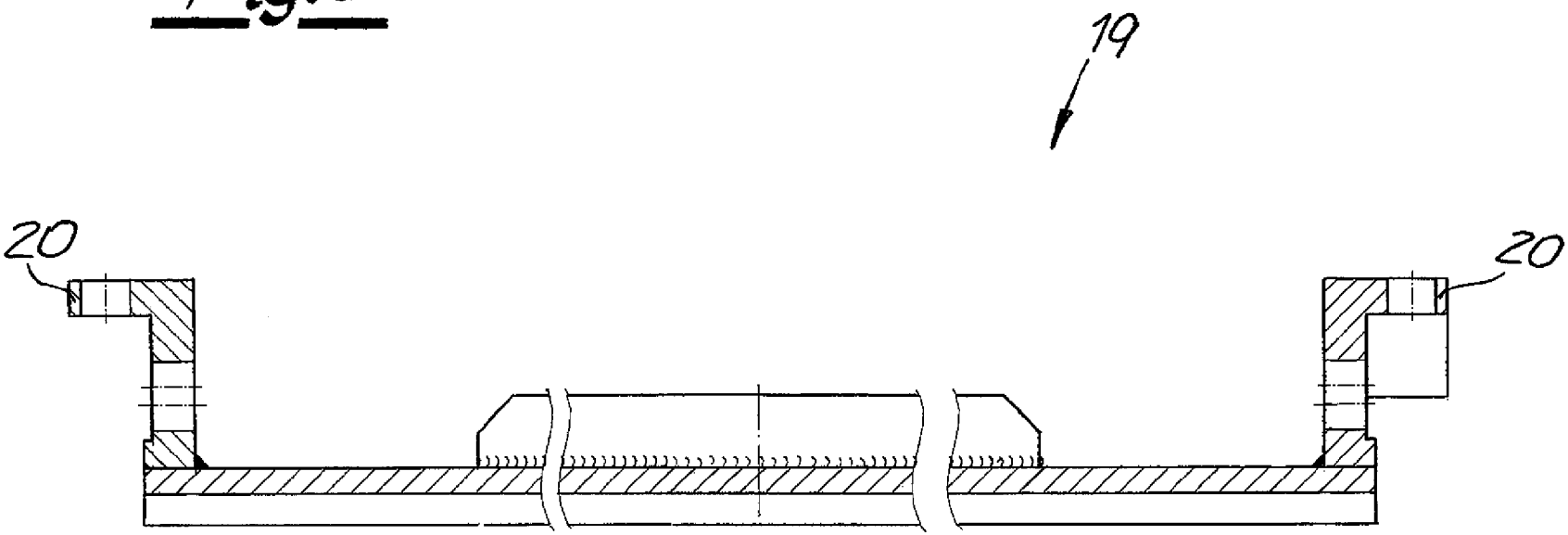
FIG. 5 shows a casing segment according to the invention for the pump of FIG. 1.

At their ends, casing segments 19 externally contacting the stator 1 have attachment flanges 20 for their attachment to the adapters 11 and 12. These attachment flanges 20 overlap the respective adapters 11 and 12. FIG. 5 shows that the attachment flanges 20 are attached to the casing segments 19 by welds. However, the casing segments 20 can also each be fabricated in a one-piece design integrated with the respective attachment flanges. For clamping the stator 1, the attachment flanges 20 have fasteners 21 that here are screw assemblies 22, 23. To this end, the drawing shows that several threaded studs 22 are provided on each of the connecting flanges 9 and 10 or adapters 11 and 12. After the casing segments 19 along with their attachment flanges 20 are installed, the desired prestresses can be set by appropriate nuts 23. The end the attachment flanges have holes through which pass the studs 22 or appropriate screws or bolts. The drawing shows that the attachment is effected with an adjustable annular gap R between the attachment flanges of casing segments 19 and the adapters. The desired initial prestress can thus be set or readjusted by adjusting this annular gap R. Otherwise, the casing segments 19 can be fixed by screw fasteners 24 fitted axially or longitudinally through the adapters or flanges.

Figure 6:
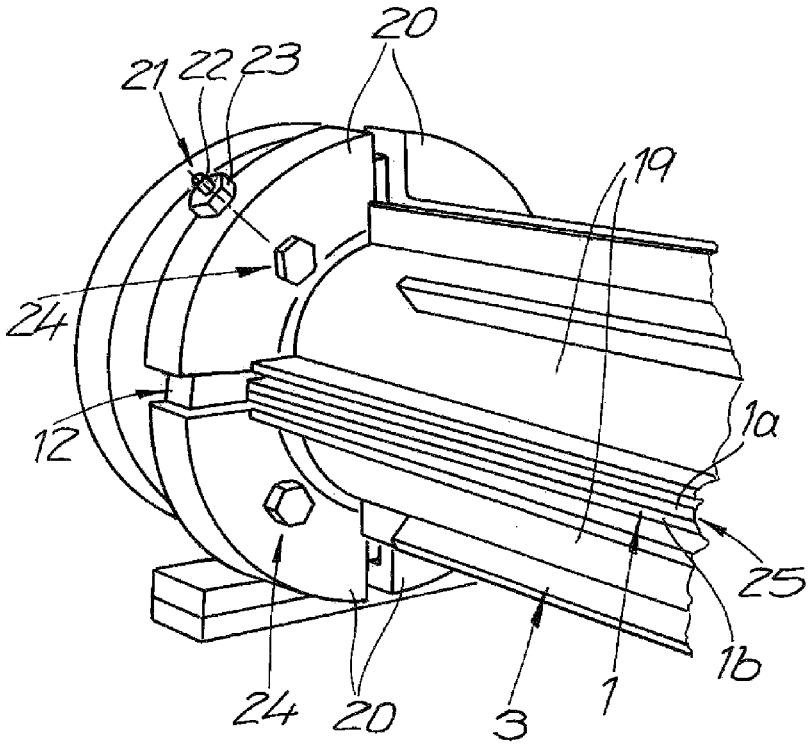
FIG. 6 is a perspective view showing a detail of the pump of FIG. 1.
Figure 7:
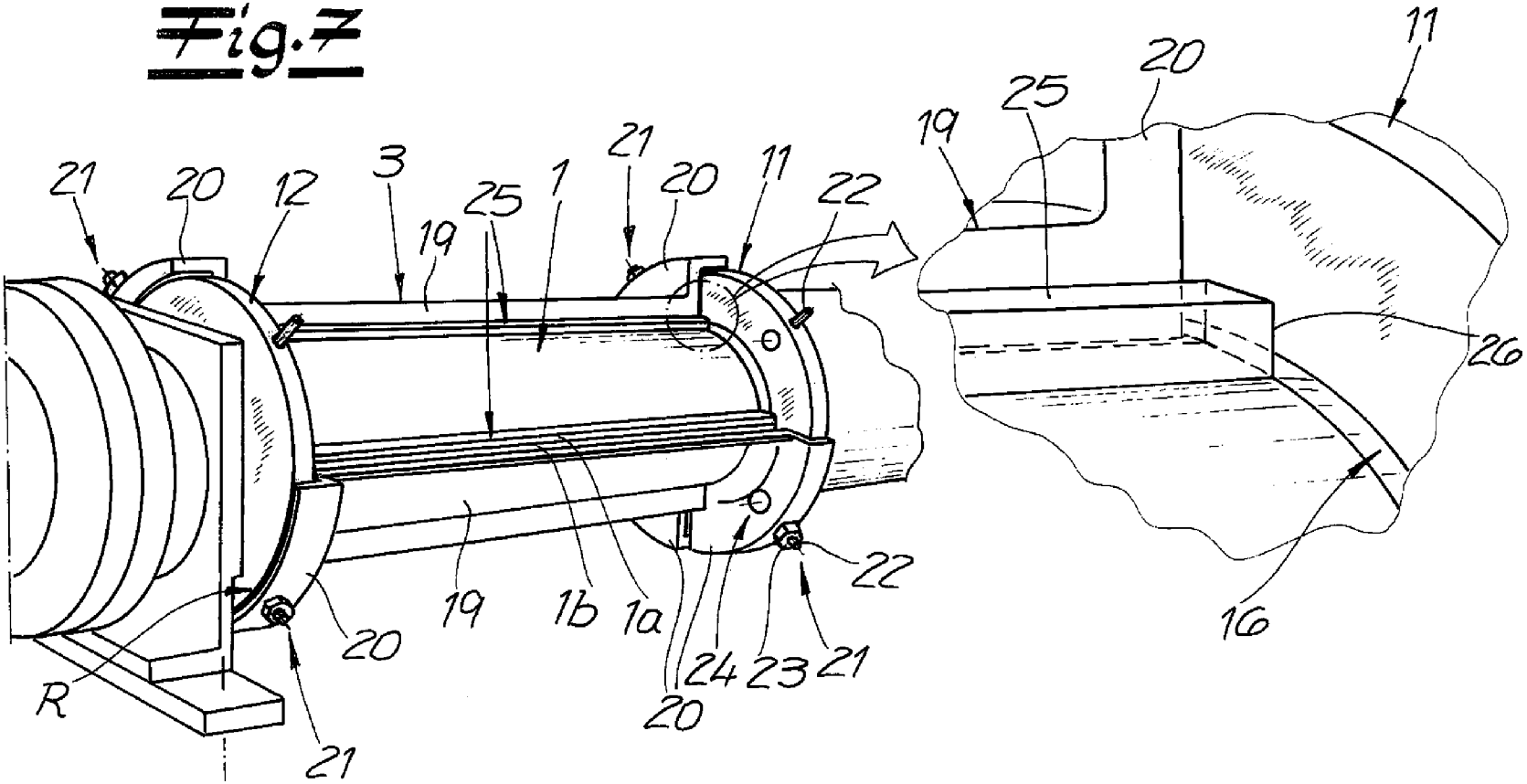
FIG. 7 is another view showing the pump of FIG. 6 in a partly disassembled state.
Figure 8:
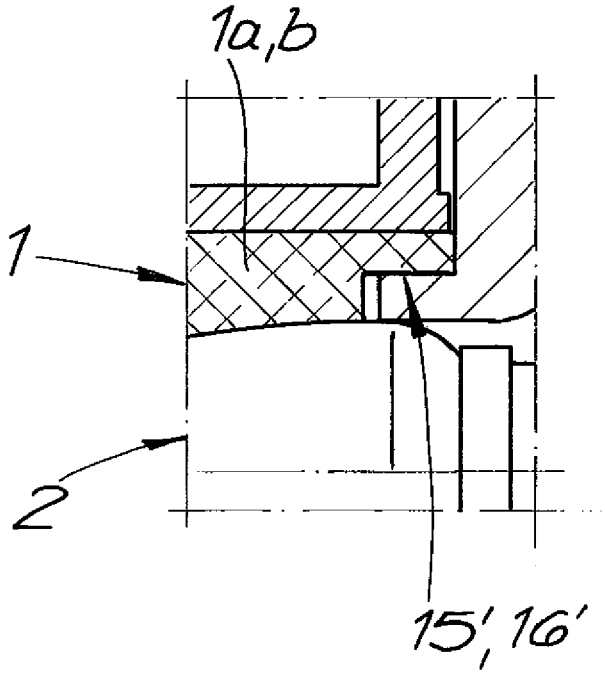
FIG. 8 is a detail from a modified embodiment of the invention.

In addition, the stator shells 1*a* and 1*b* each have at least one externally projecting rotation-blocking formation 25 that in the embodiment is a longitudinal ridge 25 extending along nearly the entire length of the stator, these ridges being molded or for example vulcanized onto the outside of the stator. FIG. 6, in particular, shows that these longitudinal ridges 25 fit into gaps between adjacent casing segments 19 as assembly proceeds, with the result that each longitudinal ridge is clamped tight between two adjacent casing segments 19, thereby solidly blocking rotation. In addition, the longitudinal ridges 25 also serve for axial retention since they extend axially full length between the adapters and form their ends stop faces 26 that bear against the adapters 11 and 12.

During fabrication, the longitudinally split stator 1 according to the invention is preferably first made as a one-piece stator 1 and then split, for example by water-jet cutting. This provides simple and cost-effective fabrication.

FIGS. 1 through 7 show one possible embodiment in which the stator 1 is fitted into corresponding seats 15 and 16. This ensures a proper seal during clamping. FIGS. 8 through 11 show embodiments in which the stator 1 or the shells 1*a* and 1*b* forming it are fitted "outside" seats 15' and 16'. To this end, reference is first made by way of example to the simplified illustration of FIG. 8 in which the seal surfaces are formed as stepped sections.

Figure 9:
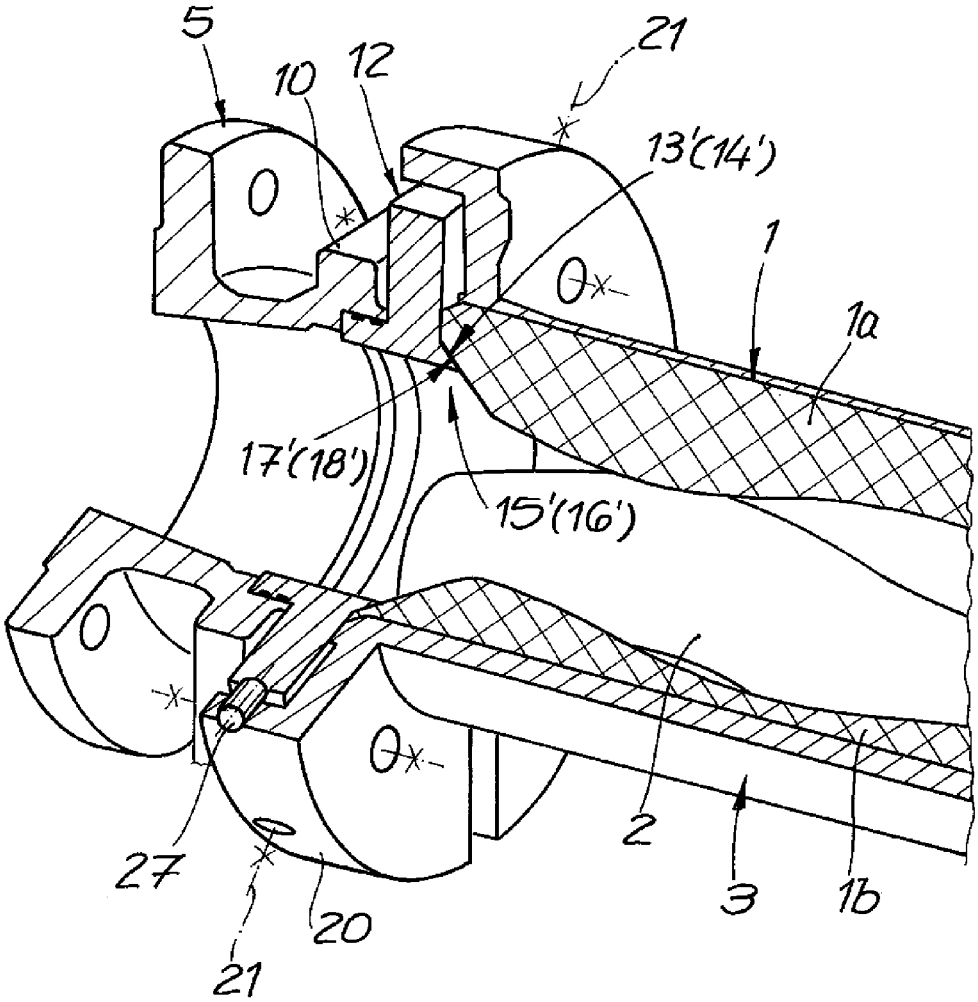
FIG. 9 is another embodiment of the invention.

FIG. 9 shows a preferred embodiment of the invention that in its fundamental design corresponds to the embodiment of FIGS. 1 through 7. It differs from this embodiment only in the ends of the stator 1 are not inserted into seats, but instead are fitted over the seats 15' and 16'. The stator thus has end seal surfaces 13' and 14' that are of internal frustoconical shape. The stator seats 15' and 16' thus have corresponding external frustoconical seal surfaces 17' and 18'. The stator seats 15' and 16' are thus each formed by a collar projecting axially outward and in this embodiment molded onto the adapter. As a result, these stator seats 15' and 16' essentially engage the interior of the stator end of the stator 1. FIG. 9 shows, strictly speaking, only the end of the system with reference numbers 13', 15', and 17'. Reference numbers 14', 16', and 18', which relate to the opposite unillustrated end are therefore provided in parentheses for the sake of completeness. Otherwise, the stator 1 in this embodiment is also of a multipart design. In terms of details, the design, aside from the configuration of the stator seats and seal surfaces, matches the design of FIGS. 1 through 7.

FIG. 9 also shows that means is provided on the connecting flanges and/or adapters for resisting angular or radial forces. To this end, FIG. 9 shows threaded studs 27 projecting radially from the adapters and fitting in respective recesses in the stator casing or its attachment flanges 20. These threaded studs 27 are thus provided to supplement the fasteners 21 already provided. Whereas adjustment of the segments can be effected by fasteners 21, the threaded studs 27 function to withstand angular or radial forces.

Figure 10:
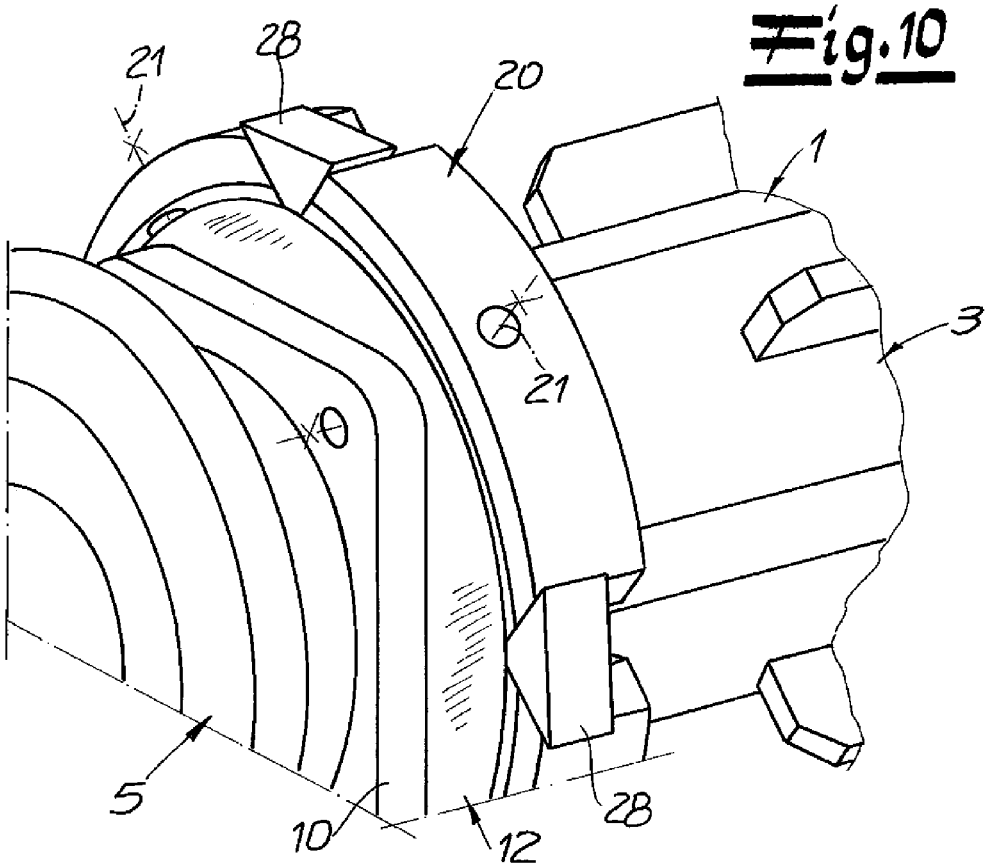
FIG. 10 is a modified embodiment of the invention.

FIG. 10 illustrates by way of example an alternative possibility for accommodating angular or radial forces. Threaded studs 27 shown in FIG. 9 have been eliminated in this embodiment. Instead, spacers in the form of wedges 28 have been inserted between the individual casing segments that here are wedge-shaped.

Figure 11:
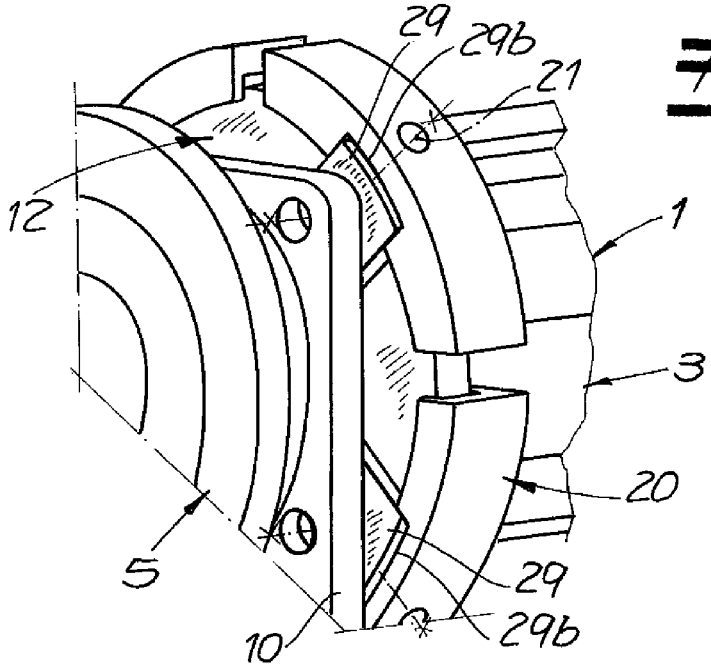
FIG. 11 is another embodiment of the invention.

Finally, FIG. 11 illustrates another possibility for resisting angular or radial forces. For this purpose, an interlock formation is provided between the connecting flanges or adapters on the one side and the casing segments or their attachment flanges on the other side. In the embodiment of FIG. 11, projecting claws 29 are provided that engage in respective seats or recesses 29*b* on each casing segment or its attachment flange. This approach provides axial and radial locking by means of these interlock formations, for example claws, on the centering ring on one side end and the stator adjustment segment on the other side.

The invention claimed is:

1. An eccentric screw pump comprising:

a plurality of segments extending along an axis and together forming a tubular casing generally centered on the axis;

a plurality of axially extending stator shells of elastic material together forming inside the casing a tubular stator having axially opposite ends each having centered on the axis a frustoconical end seal surface, the stator shells being separable from the casing segments;

an intake housing having a connecting flange formed centered on the axis with a frustoconical flange surface fitted with one of the end seal surfaces of the stator;

an output fitting having a connecting flange formed centered on the axis with a frustoconical flange surface fitted with the other of the end seal surfaces of the stator; and a rotor extending axially in the stator, the stator being clamped by the casing against the rotor.

2. The eccentric screw pump according to claim 1, further comprising;

respective adaptors connecting the flanges to the end surfaces of.

3. The eccentric screw pump according to claim 1 wherein an apex angle of the seal surfaces is approximately 10° to 50°.

4. The eccentric screw pump according to claim 1 wherein the casing segments bear externally against the stator and have end attachment flanges for attachment to the connecting flanges.

5. The eccentric screw pump according to claim 4, further comprising:

fasteners clamping the attachment flanges to the connecting flanges.

6. The eccentric screw pump according to claim 5, wherein the fasteners are screw assemblies.

7. The eccentric screw pump according to claim 4 wherein the attachment flanges form an adjustable annular gap with the connecting flanges.

8. The eccentric screw pump according to claim 4 wherein the attachment flanges overlap or surround the connecting flange.

9. The eccentric screw pump according to claim 1 wherein one or more of the stator shells has at least one externally projecting rotation-blocking formation.

10. The eccentric screw pump according to claim 9, wherein the rotation-blocking formations us longitudinal ridge attached onto outside of the stator shells.

11. The eccentric screw pump according to claim 10, wherein the longitudinal ridge has end faces acting as axial stops.

* * * * *